US007237773B1

(12) United States Patent
Spall

(10) Patent No.: US 7,237,773 B1
(45) Date of Patent: Jul. 3, 2007

(54) SYSTEM FOR FEEDING AND TRANSPORTING DOCUMENTS

(75) Inventor: J. Michael Spall, Commerce, MI (US)

(73) Assignee: Unisys Corporation, Blue Bell, PA (US)

( * ) Notice: Subject to any disclaimer, the term of this patent is extended or adjusted under 35 U.S.C. 154(b) by 429 days.

(21) Appl. No.: 10/855,752

(22) Filed: May 27, 2004

(51) Int. Cl.
*B65H 1/02* (2006.01)

(52) U.S. Cl. ..... 271/149; 271/160

(58) Field of Classification Search ..... 271/149, 271/160, 3.12, 31.1, 129, 181; 221/279, 221/280
See application file for complete search history.

(56) References Cited

U.S. PATENT DOCUMENTS

| | | | | | |
|---|---|---|---|---|---|
| 625,861 | A | * | 5/1899 | Vail et al. | 101/240 |
| 2,853,298 | A | * | 9/1958 | Faeber | 271/210 |
| 3,162,438 | A | * | 12/1964 | Perry, Jr. | 271/187 |
| 3,240,489 | A | * | 3/1966 | Eckert, Jr. et al. | 271/146 |
| 3,598,399 | A | * | 8/1971 | Cottrell | 271/146 |
| 3,811,549 | A | * | 5/1974 | Preisig | 198/419.2 |
| 3,865,365 | A | * | 2/1975 | Hardin et al. | 271/214 |
| 4,065,123 | A | * | 12/1977 | Arrasmith et al. | 271/215 |
| 4,323,230 | A | * | 4/1982 | Rising | 271/12 |
| 4,524,965 | A | * | 6/1985 | Kulpa | 271/214 |
| 4,662,623 | A | * | 5/1987 | Nakanishi | 271/150 |
| 4,928,952 | A | * | 5/1990 | Svyatsky | 271/150 |
| 4,953,748 | A | * | 9/1990 | Wheelock | 221/59 |
| 5,150,818 | A | * | 9/1992 | DeMoss | 221/228 |
| 5,419,546 | A | | 5/1995 | Chen et al. | |
| 5,437,375 | A | | 8/1995 | Chen et al. | |
| 5,439,506 | A | | 8/1995 | Chen et al. | |
| 5,509,648 | A | | 4/1996 | Chen et al. | |
| 5,524,876 | A | * | 6/1996 | Porter | 271/178 |
| 5,671,919 | A | | 9/1997 | Chen et al. | |
| 5,848,784 | A | | 12/1998 | Tranquilla | |
| 5,890,712 | A | * | 4/1999 | Phillips et al. | 271/157 |
| 5,908,191 | A | | 6/1999 | Chen et al. | |
| 5,957,448 | A | * | 9/1999 | Frank et al. | 271/152 |
| 5,971,391 | A | * | 10/1999 | Salomon et al. | 271/153 |
| 6,199,854 | B1 | | 3/2001 | Tranquilla et al. | |
| 6,260,841 | B1 | | 7/2001 | Tranquilla | |
| 6,417,221 | B1 | | 7/2002 | Meltzer et al. | |
| 6,419,221 | B1 | * | 7/2002 | Spall | 271/31.1 |
| 6,434,851 | B1 | * | 8/2002 | Nishina | 33/559 |
| 6,454,253 | B1 | * | 9/2002 | Tranquillla | 271/34 |
| 6,474,637 | B1 | | 11/2002 | Spall et al. | |
| 6,588,743 | B2 | * | 7/2003 | Yap | 271/215 |
| 6,817,607 | B2 | * | 11/2004 | Gasch | 271/177 |
| 7,040,618 | B2 | * | 5/2006 | Monch | 271/315 |

* cited by examiner

*Primary Examiner*—Patrick Mackey
*Assistant Examiner*—Jeremy R Severson
(74) *Attorney, Agent, or Firm*—Richard J. Gregson; Brooks Kushman P.C.

(57) ABSTRACT

A system for feeding and transporting documents includes a feeder stage and a transport stage. The hopper assembly includes a hopper floor that carries the document stack and a flag that provides a force to move the documents along the hopper floor toward the feeder. A fixed force means biases the flag with a fixed force while a spring means biases the flag with a variable spring force. The spring force varies with flag position to cause each document in the stack to be fed with an appropriate force due to spring force decreasing as the stack size diminishes.

12 Claims, 2 Drawing Sheets

SYSTEM FOR FEEDING AND TRANSPORTING DOCUMENTS

BACKGROUND OF THE INVENTION

1. Field of the Invention

The invention relates to systems for feeding and transporting documents and to document hoppers used in these systems.

2. Background Art

A typical system for feeding and transporting documents includes a feeder in the document feeding portion of the system, and a series of roller pairs or belts in the document transporting portion of the system. In the feeding portion of the system, the feeder acts to separate and feed documents singly, in order, from a stack. In the transporting portion of the system, the roller pairs and/or belts convey the documents, one at a time, past other processing devices such as readers, printers, and sorters that perform operations on the documents. The feeder is typically a feed wheel, but may take other forms. Further, the components in the transporting portion of the system may take a variety of forms. An existing document feeder is shown in U.S. Pat. No. 6,199,854. That patent describes a document feeder with a variable speed separator.

In existing systems for feeding and transporting documents, operations that depend on the position of the document are generally performed in the transport stage, or transporting portion of the system. For example, U.S. Pat. No. 5,848,784 describes a document separation apparatus. That patent describes the downstream acceleration/deceleration of documents with pinch rollers to adjust document spacing. U.S. Pat. Nos. 5,419,546; 5,437,375; 5,439,506; 5,509,648; 5,671,919; and 5,908,191 describe examples of other document operations.

As modern document handling devices are typically fitted with an automatic feeder mechanism to singly introduce documents into a track for further processing, a hopper is usually associated with the feeder so that the machine can load a number of documents to be processed. As feed rates increase, and feed mechanism reliability improves, there are advantages to making hopper capacity larger.

The difficulty with making hopper capacity larger is one of consistency. Document feeders need to have a supply of documents presented to the feeding mechanism in a consistent manner. This is the task of the document hopper. The variety of documents used in different applications make such consistent presentation difficult.

There is an ideal set of forces for feeding a document in a given feeder. The closer each document can be to this ideal set of forces, the better feeder performance will be. More specifically, the feeder must apply enough pinch force to allow the document to feed, but not so much as to result in the tearing apart of the document during feeding. As hopper capacity is increased, the variation in force against the stack between that needed to move a full hopper of documents and that needed to move the last few documents and provide an acceptable force to the document being fed is increased.

Typically, some form of mechanical intervention urges the document stack along in the hopper but the mechanical intervention may not compensate as the document stack diminishes. For a large capacity hopper, it is possible that the mechanical intervention may result in correct pinch force when the hopper is full but too much pinch force when the hopper nears empty, or that the mechanical intervention may result in correct pinch force when the hopper is near empty but too little pinch force when the hopper is full.

An existing form of mechanical intervention used to urge the document stack along in the hopper applies a generally constant force to the document stack. This form of mechanical intervention may limit the hopper capacity because the applied force to the stack must result in acceptable forces on a feeding document when moving a full hopper of documents and when moving the last few documents.

In this existing approach, the horizontal force used to move documents in the hopper toward the feeding mechanism is provided by a flag. A weight is hung on a string which pulls the flag across the hopper. The flag weight in this case is constant. However, as the number of documents in the hopper decreases, the force required to move them decreases. Therefore, a constant flag weight is not ideal.

In another approach, a flag may be driven by a spring. Properly located, a spring will provide a flag force which diminishes as the number of documents in the hopper diminishes. This approach also is not ideal. The flag also experiences some constant forces such as bearing drag, which a spring does not properly address. Further, for many hoppers, the need for very long travel and low forces leads to a badly proportioned spring design.

In another approach, a flag may be driven by a motor. The motor may be provided with feedback from sensors on the feeder mechanism, creating an ideal but complex and more expensive solution.

Additional background information may be found in U.S. Pat. Nos. 6,474,637; 6,417,221; and 6,260,841.

For the foregoing reasons, there is a need for an improved system for feeding and transporting documents that urges the document stack along in the hopper in a way that provides a consistent presentation of documents to the feeder.

SUMMARY OF THE INVENTION

It is, therefore, an object of the invention to provide an improved system for feeding and transporting documents that urges the stack of documents in the hopper toward the feeder in a way that provides consistent presentation of documents to the feeder while addressing the fixed and variable forces encountered in flag travel.

In carrying out the invention, a system for feeding and transporting documents is provided. Each document has a leading edge and a trailing edge. The system comprises a feeder stage and a transport stage. The feeder stage includes a hopper assembly and a feeder. The feeder acts to feed documents singly, in order, from a stack of documents provided by the hopper assembly. The transport stage is downstream of the feeder stage for receiving the fed documents.

The hopper assembly includes a hopper floor that carries the stack of documents, and a flag that provides a horizontal force to move documents along the hopper floor toward the feeder. The hopper assembly further includes a fixed force means for biasing the flag with a fixed force so as to urge the document stack toward the feeder, and a spring means for biasing the flag with a variable spring force so as to urge the document stack toward the feeder.

The fixed force means may take the form of a pulley system and a suspended weight or any other suitable form that directs a generally fixed force to the flag. The spring means may take the form of a pulley system and a spring mounted to a stationary mount from one end or any other suitable form that directs an additive variable spring force to the flag. It is appreciated that the variable force is from a spring means and not from a constant torque or controlled motor; this allows for an entirely mechanical solution. That is, the spring means directs a variable force to the flag so as to urge the document stack with a force that varies with flag position. In this way, each document in the stack may be fed with a force closer to the ideal set of forces because the spring force decreases as the stack size diminishes.

The fixed force means addresses constant loads encountered by the flag such as bearing drag. The spring means addresses variable loads encountered by the flag such as the friction forces that vary depending on the current number of documents in the stack. Steps may be taken to reduce the overall friction effects such as vibrating the hopper floor.

It is appreciated that the invention involves a fixed force means and a spring means directed to the flag in the hopper assembly. The details of the fixed force means and the spring means may vary depending on the implementation. At a more detailed level, the invention comprehends several preferred features that each may or may not be present depending on the particular implementation.

In one aspect, the invention comprehends a fixed force means including a pulley system and a weight arranged such that a force of gravity on the weight is directed by the pulley system to the flag. In another aspect, the invention comprehends a pulley system and spring arranged such that the spring force is directed by the pulley system to the flag. The pulley system may be configured such that the flag displacement exceeds the spring displacement.

In another aspect, a pivoting arm has a first end that is fixed and a second end that is free. The pivoting arm is connected to the flag by the pulley system and the spring has a first end is connected to a fixed mount and a second end connected to the pivoting arm but offset from the pulley system connection to reduce spring displacement with respect to flag displacement.

In another aspect, the first end of the spring may be connected to any one of a plurality of first spring mount locations on the machine frame. In another aspect, the second end of the spring may be connected to any one of a plurality of second spring mount locations on the pivoting arm. In this way, the orientation of the spring with respect to the pivot arm as well as the attachment point of the spring to the pivot arm with respect to the attachment of the pulley system to the pivot arm may be selected to provide the desired performance needed for the particular implementation.

DETAILED DESCRIPTION OF THE PREFERRED EMBODIMENT

Figure 1:
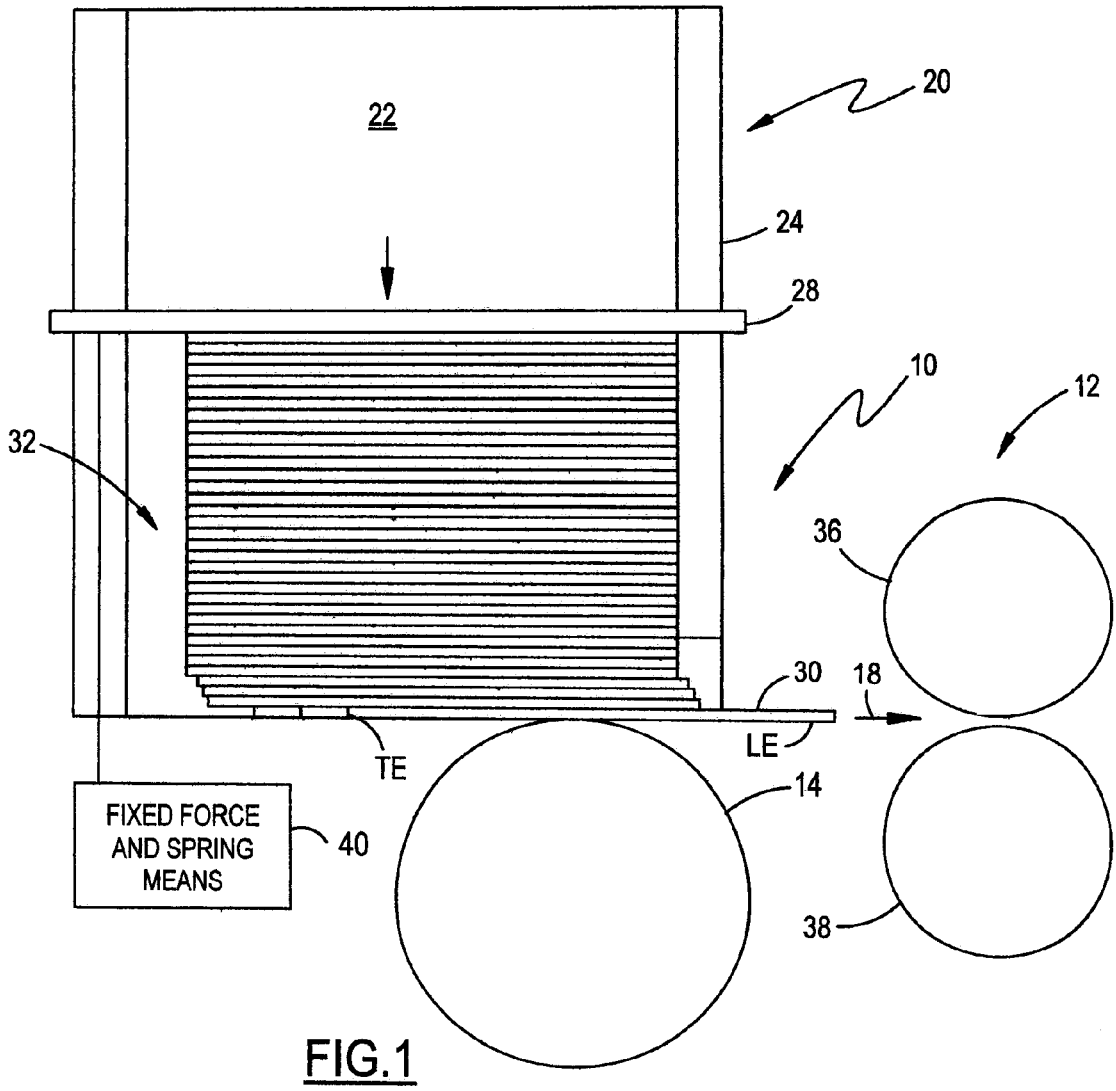
FIG. 1 is a plan view illustrating an exemplary system for feeding and transporting documents in accordance with the invention.
Figure 2:
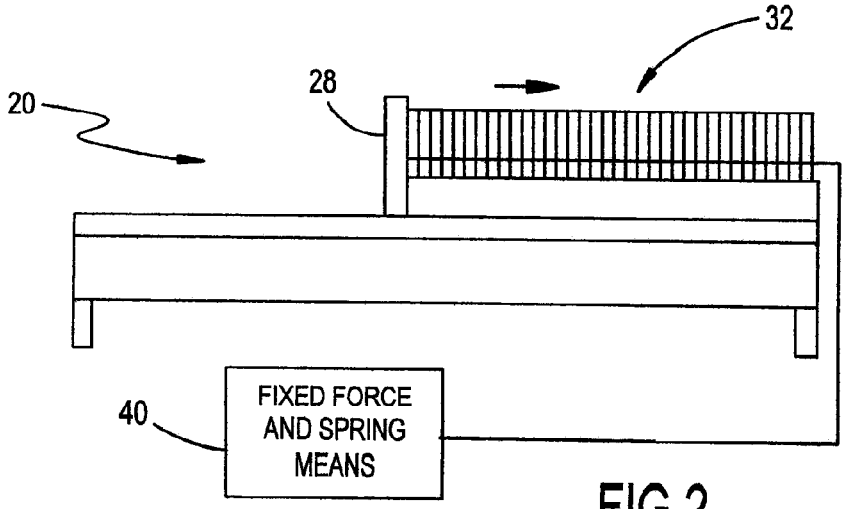
FIG. 2 is a side view showing the hopper assembly and the use of the fixed force means and spring means to urge the stack of documents in the hopper assembly toward the feeder.

FIG. 1 illustrates a system for feeding and transporting documents. The system includes a feeder stage 10 and a transport stage 12. The feeder stage 10 includes feeder 14. Transport stage 12 is downstream of feeder stage 10, with arrow 18 pointing in the downstream direction. A document leading edge LE is the more downstream edge while the trailing edge TE is the more upstream edge. Feeder stage 10 further includes hopper assembly 20. Hopper assembly 20 includes a hopper floor 22 and hopper sidewall 24. Hopper assembly 20 further includes document stack supporter or flag 28. A stack 32 of documents engages hopper floor 22. FIG. 2 shows hopper assembly 20 from the side.

With continuing reference to FIGS. 1 and 2, document stack 32 is shown adjacent to hopper sidewall 24 and includes first document 30 among other documents in stack 32, with the trailing edge TE of first document 30 still in hopper assembly 20. The components shown in FIGS. 1 and 2 are exemplary and alternative arrangements are possible as known to those skilled in the art. For example, the feeder is shown as a feed wheel 14, but may take other forms. As shown, feed wheel 14 rotates clockwise, driven by its own motor (not shown). Further, the components in transporting portion 12 may take a variety of forms as known to those skilled in the art, but for convenience of understanding are shown as an accelerator idler wheel 36 and an accelerator drive wheel 38 that rotates clockwise.

Feed wheel 14 is a typical element for feeding documents singly from a document stack. The downstream accelerator wheel pair 36, 38 accepts the document from feed wheel 14. The accelerator drive wheel 38 may or may not be driven by the same motor that drives feed wheel 14 and may run at the same or higher peripheral speed than feed wheel 14. Further, feed wheel 14 may or may not have a greater grip on the document than the accelerator wheel pair, depending upon the application. Feed wheel 14 may or may not have attached to it a device to indicate relative feed wheel position.

Flag 28 provides a force to move document stack 32 along hopper floor 22 toward feed wheel 14. Flag 28 is biased to urge document stack 32 toward the feeder by fixed force means and spring means indicated at block 40.

The fixed force means biases the flag 28 with a fixed force urging the document stack 32 toward the feeder 14. The spring means biases the flag 28 with a variable spring force urging the document stack 32 toward the feeder 14. It is appreciated that the fixed force means may take any suitable form that directs a generally fixed force to flag 28. It is appreciated that the spring means may take any suitable form that directs an additive variable spring force to flag 28. It is appreciated that the variable force is from a spring means and not from a constant torque or controlled motor. This allows for an entirely mechanical solution. The spring means directs a variable force to the flag 28 that varies with flag position. In this way, each document in the stack may be fed with a force closer to the ideal set of forces because the spring force decreases as the stack size diminishes.

Figure 3:
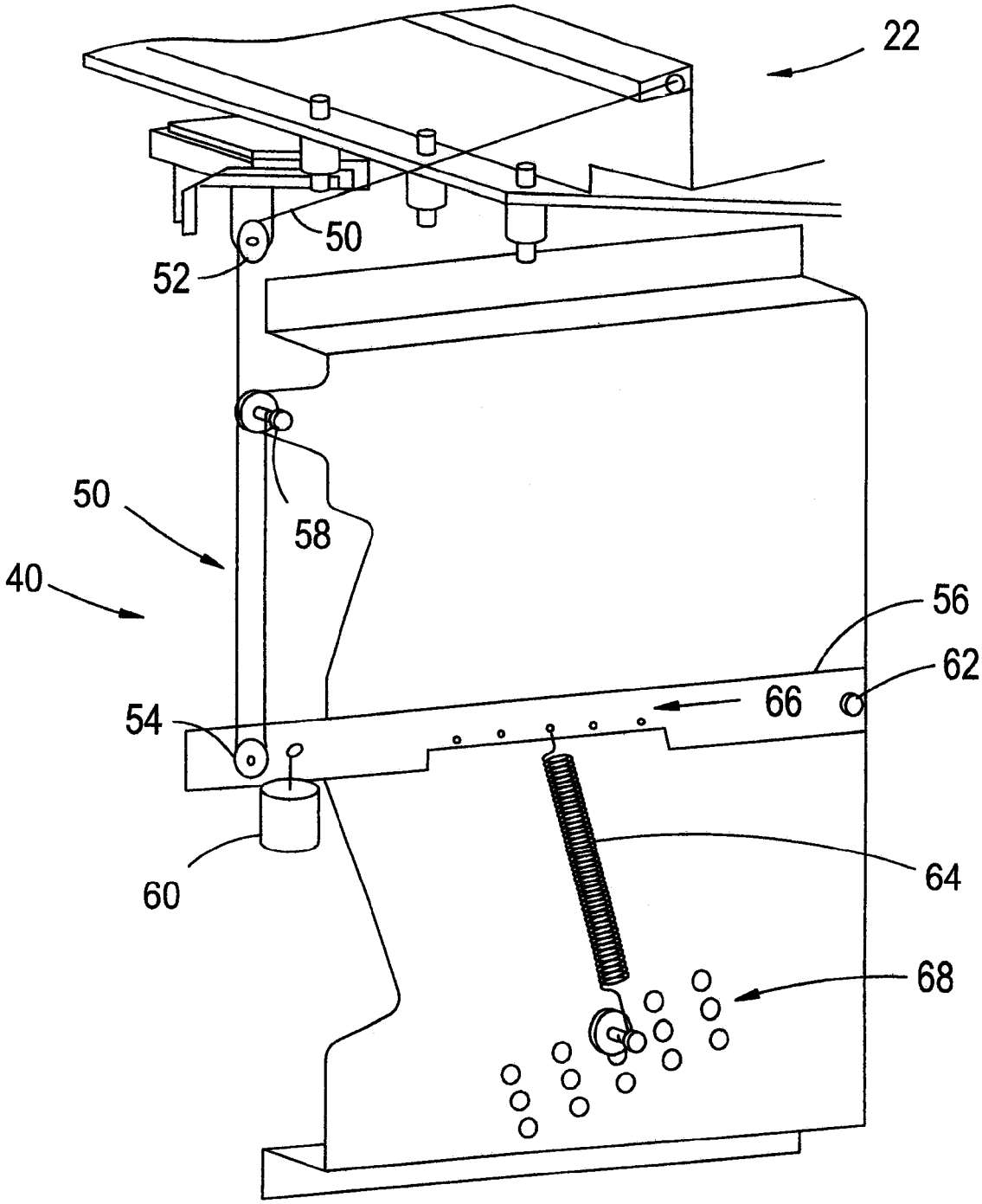
FIG. 3 is an enlarged perspective view of the fixed force means and spring means in the preferred embodiment.

FIG. 3 illustrates an implementation of the fixed force means and spring means 40 in the preferred embodiment. As shown, the hopper floor is indicated at 22, and a string or cable 50 driving the flag (not specifically shown) runs around a pulley 52, then around a pulley 54 on the end of a pivoting arm 56, and then to a fixed point 58 on the machine frame. This pulley system halves the motion and doubles the forces on the arm 56. And this provides a packaging advantage through the reduced motion. The fixed force is due to weight 60 that hangs from arm 56. Fixed weight 60 addresses constant loads encountered by the flag. The weight can be readily adjusted to tune the flag weight to a particular machine, environment, or customer. A variable force is provided by spring 64.

Spring 64 addresses variable loads encountered by the flag. Spring 64 is fixed approximately in the middle of the pivoted arm 56. This again halves the motion and again doubles the force. The combination of the pulley system and the pivoting arm allows for a common, well-proportioned spring to be used.

Further, multiple spring mounts are provided so that the effective spring rate of spring 64 can be changed. Thus, the flag weight can be tuned for a customer who uses unusually heavy or light weight documents. A plurality of mounts 66 are provided along arm 56, while a plurality of mounts 68 are provided along the machine frame.

In the preferred embodiment, the fixed force means is achieved with the pulley system and weight 60, while the spring means is achieved with the pulley system, spring 64, and pivoting arm 56. Of course, this is the preferred embodiment and other implementations for the fixed force means and spring means are possible.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for feeding and transporting documents, each document having a leading edge and a trailing edge, the system comprising:

a feeder stage including a hopper assembly and a feeder wherein the feeder acts to feed documents singly, in order, from a stack of documents in the hopper assembly, the hopper assembly including a hopper floor that carries the document stack and a flag that provides a force to move the documents along the hopper floor toward the feeder, wherein the force provided by the flag urges the document stack toward the feeder and overcomes a friction force from the hopper floor to cause the document stack to move, with respect to the hopper floor and along the hopper floor, toward the feeder;

a fixed force means for biasing the flag with a fixed force urging the document stack toward the feeder;

a spring means for biasing the flag with a variable spring force urging the document stack toward the feeder, the spring force varying with flag position to cause each document in the stack to be fed with an appropriate force due to the spring force decreasing as the stack size diminishes; and a transport stage downstream of the feeder stage for receiving the fed documents.

2. A system for feeding and transporting documents, each document having a leading edge and a trailing edge, the system comprising:

a feeder stage including a hopper assembly and a feeder wherein the feeder acts to feed documents singly, in order, from a stack of documents in the hopper assembly, the hopper assembly including a hopper floor that carries the document stack and a flag that provides a force to move the documents along the hopper floor toward the feeder;

a fixed force means for biasing the flag with a fixed force urging the document stack toward the feeder;

a spring means for biasing the flag with a variable spring force urging the document stack toward the feeder, the spring force varying with flag position to cause each document in the stack to be fed with an appropriate force due to the spring force decreasing as the stack size diminishes;

a transport stage downstream of the feeder stage for receiving the fed documents; and wherein the fixed force means includes a pulley system and a weight arranged such that a force of gravity on the weight is directed by the pulley system to the flag.

3. The system of claim 1 wherein the spring means includes a pulley system and a spring arranged such that the spring force is directed by the pulley system to the flag.

4. The system of claim 3 wherein the pulley system is configured such that the flag displacement exceeds the spring displacement.

5. A system for feeding and transporting documents, each document having a leading edge and a trailing edge, the system comprising:

a feeder stage including a hopper assembly and a feeder wherein the feeder acts to feed documents singly, in order, from a stack of documents in the hopper assembly, the hopper assembly including a hopper floor that carries the document stack and a flag that provides a force to move the documents along the hopper floor toward the feeder;

a fixed force means for biasing the flag with a fixed force urging the document stack toward the feeder;

a spring means for biasing the flag with a variable spring force urging the document stack toward the feeder, the spring force varying with flag position to cause each document in the stack to be fed with an appropriate force due to the spring force decreasing as the stack size diminishes;

a transport stage downstream of the feeder stage for receiving the fed documents;

wherein the spring means includes a pulley system and a spring arranged such that the spring force is directed by the pulley system to the flag; and a pivoting arm with a first end that is fixed and a second end that is free, the pivoting arm being connected to the flag by the pulley system and the spring having a first end that is connected to a fixed mount and a second end connected to the pivoting arm but offset from the pulley system connection to reduce spring displacement with respect to flag displacement.

6. The system of claim 5 wherein the pulley system is configured such that the flag displacement exceeds the arm displacement at the pulley system connection to the arm.

7. The system of claim 5 further comprising:

a plurality of first spring mount locations wherein the first end of the spring is connected to one of the first spring mount locations.

8. The system of claim 7 wherein the pulley system is configured such that the flag displacement exceeds the arm displacement at the pulley system connection to the arm.

9. The system of claim 5 further comprising:

a plurality of second spring mount locations on the pivoting arm wherein the second end of the spring is connected to one of the second spring mount locations.

10. The system of claim 9 wherein the pulley system is configured such that the flag displacement exceeds the arm displacement at the pulley system connection to the arm.

11. The system of claim 5 wherein the fixed force means includes a weight arranged such that a force of gravity on the weight is directed by the pulley system to the flag.

12. A system for feeding and transporting documents, each document having a leading edge and a trailing edge, the system comprising:

a feeder stage including a hopper assembly and a feeder wherein the feeder acts to feed documents singly, in order, from a stack of documents in the hopper assembly, the hopper assembly including a hopper floor that carries the document stack and a flag that provides a force to move the documents along the hopper floor toward the feeder;

a pulley system and weight arrangement, the pulley system directing a force of gravity on the weight to the flag so as to bias the flag with a fixed force urging the document stack toward the feeder;

a spring arranged so as to bias the flag with a variable spring force urging the document stack toward the feeder, the spring force varying with flag position to cause each document in the stack to be fed with an appropriate force due to the spring force decreasing as the stack size diminishes; and a transport stage downstream of the feeder stage for receiving the fed documents.

* * * * *